United States Patent [19]

Burmeister

[11] Patent Number: 4,464,548

[45] Date of Patent: Aug. 7, 1984

[54] AUTOMATIC KILN CONTROL

[75] Inventor: Lewis H. Burmeister, Brea, Calif.

[73] Assignee: W. P. Dawson, Inc., Brea, Calif.

[21] Appl. No.: 436,325

[22] Filed: Oct. 25, 1982

[51] Int. Cl.[3] ..... H01H 43/00

[52] U.S. Cl. ..... 200/33 R; 200/61.08; 200/39 R

[58] Field of Search ..... 200/33 R, 38 R, 39 R, 200/38 E, 38 A, 5 E, 324, 50 C, 61.08

[56] References Cited

U.S. PATENT DOCUMENTS

| | | | |
|---|---|---|---|
| 3,287,530 | 11/1966 | Dawson | 200/16 A |
| 3,489,015 | 1/1970 | Harris | 200/38 R |
| 3,881,075 | 4/1975 | Kitai | 200/38 A |

*Primary Examiner*—Joseph W. Hartary
*Assistant Examiner*—Morris Ginsburg
*Attorney, Agent, or Firm*—Gene W. Arant; Paul H. Ware

[57] ABSTRACT

An automatically controlled electric circuit interrupting device for controlling electric power supplied to the heating elements of kiln furnaces responsive to parallel input stimuli.

4 Claims, 7 Drawing Figures

AUTOMATIC KILN CONTROL

BACKGROUND OF THE INVENTION

This invention relates to automatically controlled electric circuit interrupting devices and more particularly to such devices that interrupt electric power supplied to a kiln in response to more than one parallel input stimulus.

In the operation of kilns it has long been the practice to utilize pyrometric cones to determine when the process of firing a work piece in the kiln has been completed. In a representative case, the kiln operator will observe such a cone in the kiln firing environment for physical changes. It is a characteristic of the material of such cones that the cone becomes softened after exposure to elevated temperature for a sufficient length of time. The cone will suffer a physical distortion thus altering the kiln operator that the process is complete.

Advantage was taken of this physical distortion in U.S. Pat. No. 3,287,530, issued to W. P. Dawson Nov. 22, 1966. A pyrometric cone, utilized as support for an actuator rod, becomes softened by time exposure to an elevated temperature in the kiln. Upon such softening, the pyrometric cone no longer provides support for the actuating rod thus allowing release of a contact-opening mechanism so as to open the electric circuit supplying power to the heating elements of the kiln.

It is desirable to provide accompanying control means, operable in response to stimuli other than the physical distortion of the pyrometric cone, in order to invest the kiln operator with additional control over the treatment of a kiln-fired workpiece. It is further desirable to provide an interlock mechanism by means of which power to the heating elements of the kiln may be interrupted by opening the lid of the kiln.

SUMMARY OF THE INVENTION

It is therefore a primary objective and purpose of the present invention to provide an improved switching device responsive to more than one stimulus for controlling a kiln.

A further object of the invention is to provide a kiln operator with greater control over a kiln-firing process than has heretofore been available.

Yet another object of the present invention is to provide for the control mentioned above in an economical and conveniently incorporated device such that retrofit of operating kilns may be conveniently accomplished so as to incorporate the advantages of the present invention.

A still further object of the present invention is to provide an interlock mechanism by means of which electric power to the heating elements of a kiln will be interrupted by opening the kiln lid.

Other objects and advantages of the invention will appear and be brought out more fully in the following specification, reference being had to the accompanying drawings wherein like reference numerals refer to like parts throughout and in which:

DRAWING SUMMARY

CROSS REFERENCE TO RELATED APPLICATION

Essential material as disclosed in U.S. Pat. No. 3,287,530 is by this reference incorporated herein and made a part of this specification hereof as material necessary for adequate disclosure of the invention. The invention as further disclosed herein is an improvement of the above referenced patent.

DETAILED DESCRIPTION

Figure 1:
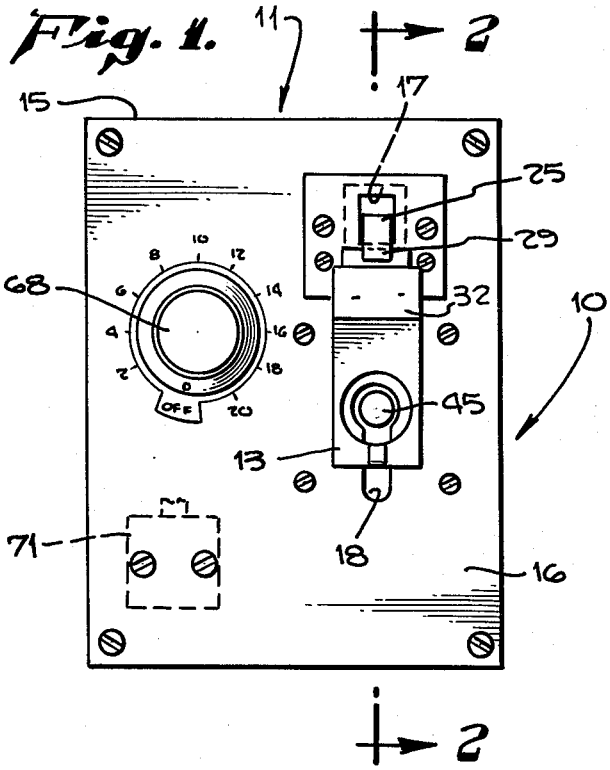
FIG. 1 is a plan view of the front panel of the device in accordance with the invention showing a release mechanism disposed in its operable, latched position and a timer control knob.
Figure 3:
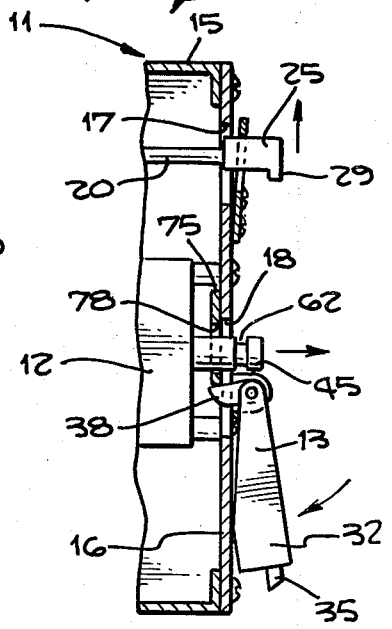
FIG. 3 is a side elevation showing the release mechanism in its operated, unlatched position.
Figure 7:
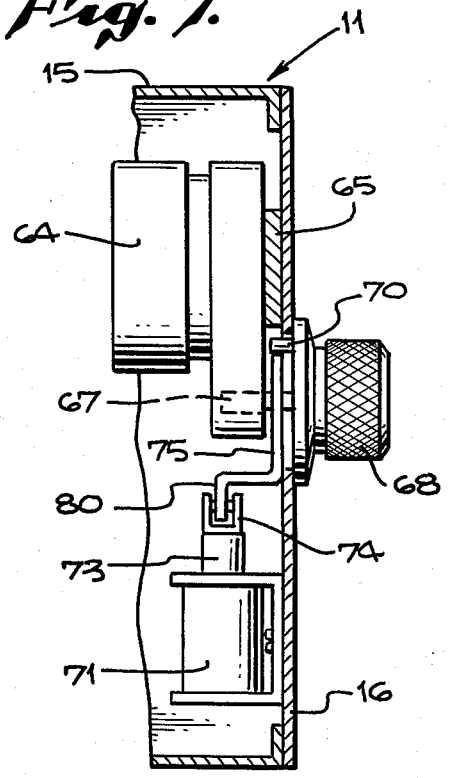
FIG. 7 is a side view taken along a line 7—7 of FIG. 4, showing the timer control knob and the solenoid to further facilitate describing the operation of the device of the invention.
Figure 2:
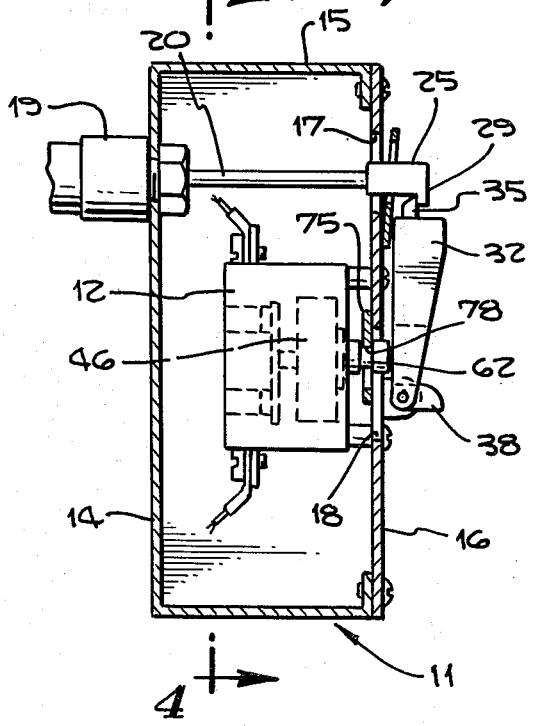
FIG. 2 is a cross-sectional view of a side elevation taken along a line 2—2 as shown in FIG. 1.

With respect to the patent as thus incorporated by reference, the operation of opening the electric power circuit to the heating elements of a kiln in response to the deformation of a pyrometric cone was fully disclosed. In order to provide continuity, reference is now made to the drawing and particularly to FIGS. 1, 2, and 3.

The switching device is denoted generally by the numeral 10 and its housing, having rear and top walls 14 and 15 respectively and a front cover plate 16, by numeral 11. Contained in housing 11 is a switch 12 the operation of which is fully explored in the incorporated patent. A release mechanism 13 having a movable weight 32 and a trigger 35, is held in a latched position by means of an actuating rod 20 which is supported in a refractory tube 19 by pyrometric cones (not shown) so as to maintain said trigger 35 in engagement with a downwardly extending lip 29 of a release claw 25, attached to said actuating rod 20 and extending through opening 17 in front cover plate 16. In this latched position, switch 12 may be maintained in an electrically closed position by retraction of a post 45 that acts upon plunger 46 to close the electrical contacts (not shown) in switch 12. Retraction of post 45 is maintained by the engagement of an annular groove 62 with the edge of an aperture 78 in a modified locking cam member to be more fully explained in what follows.

When conditions of time and temperature cause distortion of the pyrometric cones supporting actuating rod 20, trigger 35 is thereby released from downwardly extending lip 29 of release claw 25. Movable weight 32, now freed from its latching constraints, swings downwardly (clockwise in FIG. 3), causing stud 38 to free annular groove 62 from its engagement with the edge of aperture 78. Plunger 46 now is caused to move forward in response to internal spring forces (not shown) so as to open its contacts thus removing power from the heating elements of the kiln.

Figure 4:
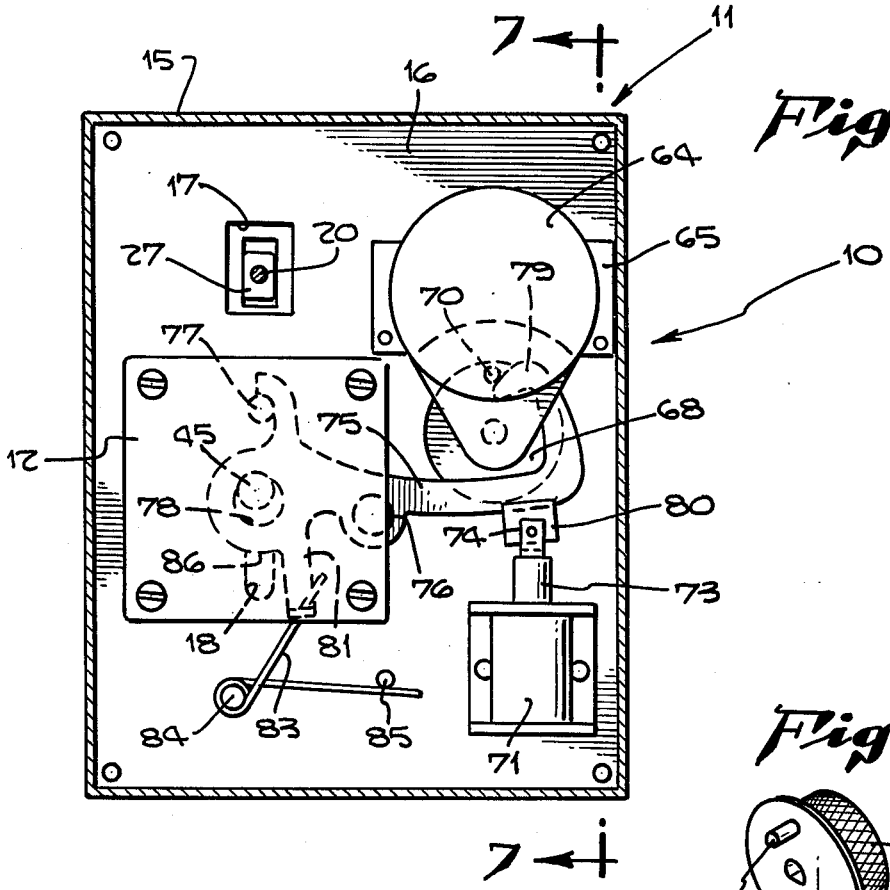
FIG. 4 is a detail view of the rear of the panel of the device taken along a line 4—4 of FIG. 2 showing the various arrangement of the parts and showing the modified locking cam disposed in its extreme counterclockwise position.
Figure 6:
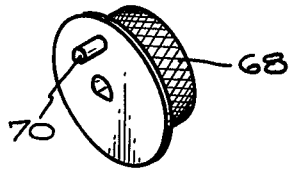
FIG. 6 is a detailed view of the timer control knob showing the control knob shaft.
Figure 5:
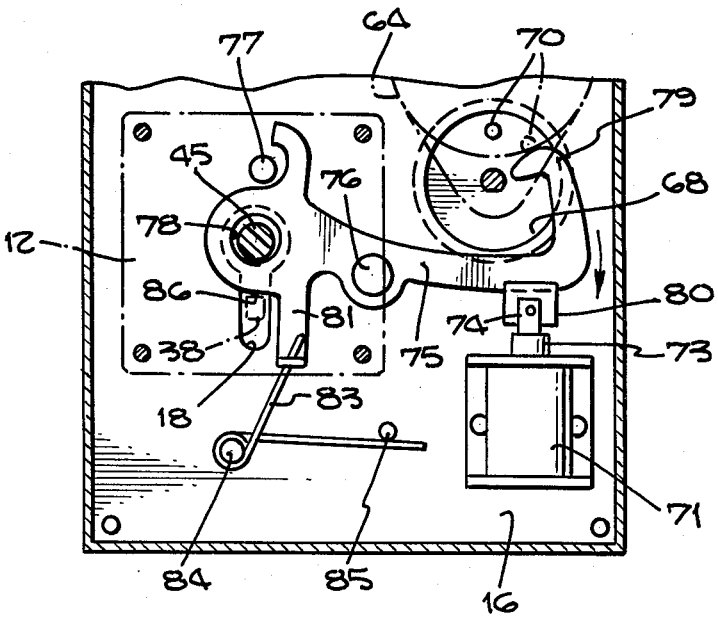
FIG. 5 is a detail view of the rear of the panel of the device showing the modified locking cam in its extreme clockwise position.

Referring now to FIG. 4 with greater particularity, the numeral 75 identifies the modified locking cam of the invention, which modified locking cam includes a threaded pivot 76 by means of which the modified locking cam can rotate within the constraints imposed by threaded stop-motion screw 77. The threaded pivot 76 serves the further purpose of rotatably fastening the modified locking cam to the removable front cover plate 16. An aperture 18 is provided through which stud 38 engages flat portion 86 of the modified locking cam upon clockwise rotation of the movable weight 32 as previously explained. Numeral 79 denotes a member responsive to a timer runout of timer 64. Timer 64 may be of a type furnished by General Time of Thomaston, Connecticut under U.S. Pat. Nos. 2,300,785; 2,334,040; and 2,353,305. Timer 64 is mounted on plate 16 by means of timer mounting plate 65. The timer has a timer control knob 68 which is fastened to a timer actuating and setting shaft 67 by means of a set screw. A control knob shaft 70 performs the function of engaging member 79 of the modified locking cam 75 at timer runout thus forcing clockwise rotation of modified locking cam 75 within the limits of its constraint, so as to release plunger 46 by forcing aperture 78 upward thereby to disengage annular groove 62 from the edge of opening 78.

The modified locking cam 75 also has a solenoid armature connecting member 80 to provide for connection to solenoid armature 73 of solenoid 71 by means of a mechanical armature connecting member 74. Conventional solenoid contacts provide for energizing the solenoid upon actuating a kiln lid switch (not shown) thus to provide an interlock switching function operable to interrupt power to the heating elements of the kiln upon opening the kiln. Upon the solenoid becoming energized, the armature 73 is drawn downward into the coil thus causing a clockwise rotation of the modified locking cam about its pivot 76 thereby disengaging annular groove 62 from the edge of opening 78 and interrupting the power circuit to the heating elements of the kiln.

The modified locking cam 75 additionally includes a spring retaining member 81 having a spring retaining opening through which one end of spring 83 is inserted. Spring tension is provided by means of first spring tensioning fastener 84 and second spring tensioning fastener 85.

It should now be apparent that interruption of the electric power to the heating elements of the kiln can be effected by three separate but parallel means operated in response to three separate stimuli.

Conventional operation of a circuit interrupting device in response to the physical deformation of a pyrometric cone has been fully narrated in U.S. Pat. No. 3,287,530, of reference herein. In the inventive device of the present invention, the "thin plate 39" of the referenced patent has been removed from the structure. In its place, the modified locking cam 75 has been incorporated so as to fully perform the functions of the "thin plate 39" and also to perform the functions that comprise the improvements characterizing the present invention. When the stud 38 enters the opening 18 as a result of the movable weight 32 falling downward from its upright position, the modified locking cam 75 is engaged at its flat portion 86 and moved upward against the force of the hair spring assembly comprising spring 83, and first and second spring tensioning fasteners 84 and 85 respectively. The modified locking cam 75 is thus caused to rotate about its threaded pivot 76 against the force of spring 83 in a clockwise direction so as to disengage annular groove 62 from the edge of opening 78 and thereby open the movable spaced-apart contacts of switch 12 to open the electrical power circuit to the heating elements of the kiln.

It is also provided by the advantages of the invention to interrupt electrical power to the heating elements of the kiln by means of the runout of a pre-set timer. Setting of timer 64 is accomplished by rotation of timer control knob 68 in a clockwise direction. The timer mechanism then begins to operate so as to rotate the knob in a counterclockwise direction until, at timer runout, the timer control knob shaft 70 engages cam member 79 so as to rotate modified locking cam 75 about its pivot 76 in a clockwise direction so as to disengage annular groove 62 from the edge of opening 78 and thereby open the movable spaced apart contacts of switch 12 to open the electric power circuit to the heating elements of the kiln. It should now be clear how the mechanism of timer 64, acting through its control knob shaft 70, can interrupt the flow of electric power to the heating elements of the kiln after the lapse of a preselected time interval.

It is further provided by the advantages of the invention to interrupt electric power to the heating elements of the kiln by means of a circuit interlock operated by opening the lid of the kiln. A switch, such as a micro switch or a mercury switch or the like, (not shown), mechanically positioned so as to have its actuator operated by the opening or closing of the lid of the kiln, is connected so as to provide energizing electric power to solenoid 71 upon opening the kiln lid. Upon such energization, the armature 73 of solenoid 71 is drawn further into the coil of the solenoid thereby imposing a pulling force on modified locking cam 75 at its mechanical armature connecting member 74. Again cam 75 is caused to rotate about its threaded pivot 76 against the force of spring 83 in a clockwise direction so as to disengage annular groove 62 from the edge of opening 78 and thereby open the movable spaced-apart contacts of switch 12 to open the electric power circuit to the heating elements of the kiln.

It should be noted that operation of the device so as to interrupt the supply of electric power to the heating elements of the kiln either by means of timer runout or by opening the lid of the kiln, does not serve to disengage the trigger 35 of the movable weight 32 from downwardly extending lip 29 of release claw 25. Power supplied to the heating elements of the kiln can be reinstated by the expedient, on the one hand, of closing the kiln lid and pressing the post 45 so as to reengage annular grove 62 with the edge of opening 78, or on the other hand of resetting timer 64 and pressing post 45 as before.

While I have herein shown and described my invention in what I have conceived to be the most practical and preferred embodiments, it is pointed out that nevertheless, verious changes and modifications, obvious to one skilled in the art to which the invention pertains are deemed to lie within the scope and purview of the invention.

What is claimed and desired to be secured by letters patent of the United States is:

1. An improved device for interrupting an electric circuit for supplying electric power to the heating elements of a kiln of the type having a ceramic switch mounted on the rear surface of a front cover plate, said switch having movable contacts located on a movable spring loaded plunger being operable by means of a post accessible through a first aperture provided through said front cover plate and capable of being latched in a switch-closed position wherein the improvement comprises:

a modified locking cam operable to latch said switch in said switch-closed position and to unlatch said switch from said switch-closed position;

said cam having a pivot permitting rotation of said cam in both clockwise and counterclockwise directions;

a stop-motion screw that limits said clockwise and counterclockwise rotations of said cam;

a second aperture through said cam in registry with said first aperture provided through said front cover plate;

a flat portion substantially below said second aperture and near one end of said cam responsive to an upwardly applied force so as to rotate said cam in said clockwise direction whereby said switch, originally latched in a switch-closed position, becomes unlatched to a switch-open position;

a hair spring assembly including a spring and having first and second spring tensioning fastening means;

a spring retaining member of said cam having a spring retaining opening operable to accept said spring having first and second spring tensioning fastening mens, said spring thereby being tensioned so as to urge said cam to the counterclockwise limit of its rotation as constrained by said stop-motion screw; and means near another end of said cam to cause clockwise rotation of said cam witin the limits of said stop-motion screw whereby said switch, originally latched in a switch-closed position, becomes unlatched to a switch-open position.

2. The device of claim 1 wherein said means near another end of said cam to cause clockwise rotation of said cam comprises:

a solenoid having a coil and mounted on the rear surface of said cover plate having contacts for energizing said solenoid coil and an armature responsive to said energization of said solenoid coil so as to draw said armature into said coil and having mechanical armature connecting means;

a solenoid armature connecting member on said cam for attachment to said mechanical armature connecting means; and means to energize said solenoid upon opening said kiln so as to cause said armature to be drawn into said solenoid coil whereby said cam is caused to rotate in a clockwise direction whereby said switch, originally latched in a switch-closed position, becomes unlatched to a switch-open position.

3. The device of claim 2 further comprising a timer mounted on said front cover plate itself comprising:

a timer actuating and setting shaft attached to a timer control knob by means of a set screw, said control knob having a control knob shaft operative to assume a fixed position upon timer run-out from an operator-set timer position; and a member on said cam, responsive to timer run-out through contact with said control knob shaft and operable to cause said cam to rotate in a clockwise direction within the limits of said stop-motion screw whereby said switch, originally latched in a switch-closed position, becomes unlatched to a switch-open position.

4. The device of claim 1 wherein said means near another end of said cam to cause clockwise rotation of said cam comprises:

a timer mounted on said front cover plate itself comprising:

a timer actuating and setting shaft attached to a timer control knob by means of a set screw, said control knob having a control knob shaft operable to assume a fixed position upon timer run-out from an operator-set timer position; and a member on said cam, responsive to timer run-out through contact with said control knob shaft and operable to cause said cam to rotate in a clockwise direction whereby said switch, originally latched in a switch-closed position, becomes unlatched to a switch-open position.

* * * * *